US005426794A

United States Patent [19]

Hennessy

[11] Patent Number: 5,426,794

[45] Date of Patent: Jun. 27, 1995

[54] VACUUM ASSISTED TOILET WITH CONTROLLED VACUUM

[75] Inventor: Arnold Hennessy, Wellington, Canada

[73] Assignee: Fluidmaster, Inc., Anaheim, Calif.

[21] Appl. No.: 194,713

[22] Filed: Feb. 10, 1994

[51] Int. Cl.[6] ..... E03D 11/00

[52] U.S. Cl. ..... 4/431; 4/328; 4/370

[58] Field of Search ..... 4/328, 368, 369, 370, 4/371, 372, 254, 431; 137/247.27, 253, 138, 139, 254

[56] References Cited

U.S. PATENT DOCUMENTS

| | | | |
|---|---|---|---|
| 255,485 | 3/1882 | Boyle | 4/328 |
| 380,854 | 4/1888 | Boyle | 4/424 X |
| 391,318 | 10/1888 | Harkins | 4/328 |
| 461,213 | 10/1891 | Boyle | 4/328 |
| 530,306 | 12/1894 | Harvey | 4/328 |
| 534,689 | 2/1895 | Hamilton | 4/424 X |
| 541,274 | 6/1895 | Hamilton | 4/424 |
| 558,130 | 4/1896 | Wallace | 4/328 |
| 902,295 | 10/1908 | Hilfiker | 4/370 |
| 3,126,906 | 3/1964 | Touzalin et al. | 137/254 |
| 4,142,262 | 3/1979 | Hamilton | 4/370 |
| 4,183,108 | 1/1980 | Hamilton | 4/370 |
| 4,800,596 | 1/1989 | Menge | 4/348 |
| 5,142,712 | 9/1992 | Hennessy | 4/328 |
| 5,170,515 | 12/1992 | Kai et al. | 4/370 |

*Primary Examiner*—Henry J. Recla
*Assistant Examiner*—Gregory M. Vidovich
*Attorney, Agent, or Firm*—Arthur Freilich; Robert Hornbaker; Leon Rosen

[57] ABSTRACT

A vacuum assisted toilet is described, of the type wherein the toilet bowl outlet has a lower trap that is open to the passage of air therethrough except during each flushing when a vacuum is applied, which uses the vacuum more effectively. A vacuum source (46, FIG. 3) includes a first container portion (107) that holds water between flushings, with the water released during a flushing and creating a vacuum in a second portion (106) of the container that is coupled through a vacuum conduit (48) to the toilet bowl outlet. Instead of constantly coupling the second portion of the container to the bowl outlet, the second portion of the container is allowed to progressively expand but remain substantially unconnected to the bowl outlet until a predetermined amount of expansion (to 108) when the second portion is suddenly connected through the vacuum conduit (48) to the bowl outlet. As a result, the vacuum created during early expansion of the second container portion does not tend to lessen the lower trap and the vacuum is not wasted to the drain, but is applied only after the lower trap is sealed.

14 Claims, 4 Drawing Sheets

FIG. 1
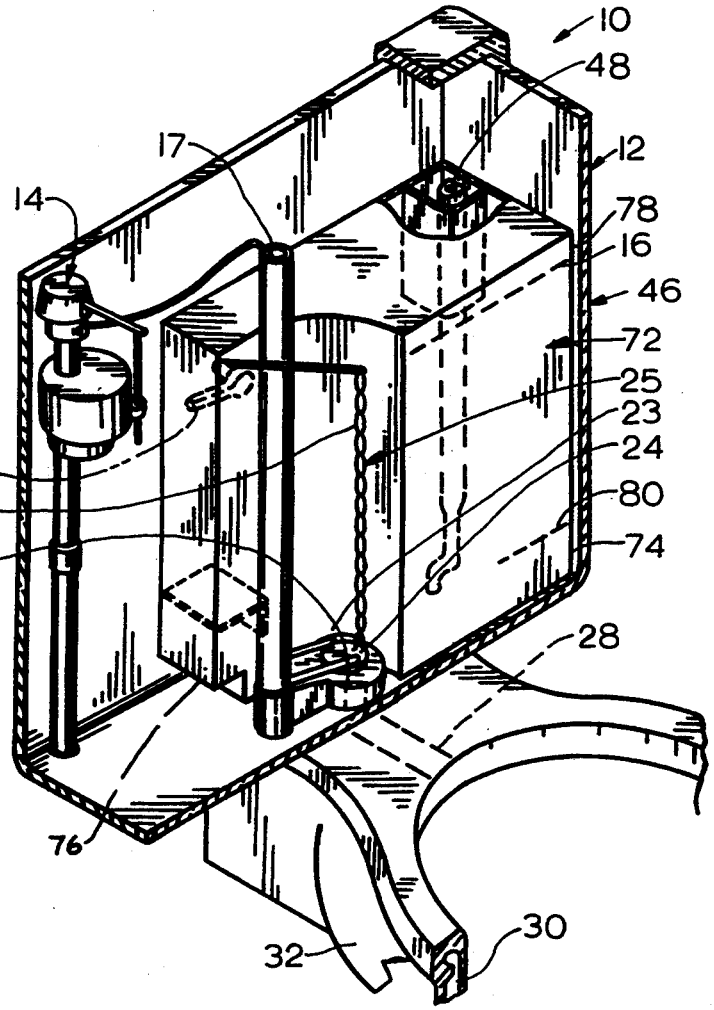
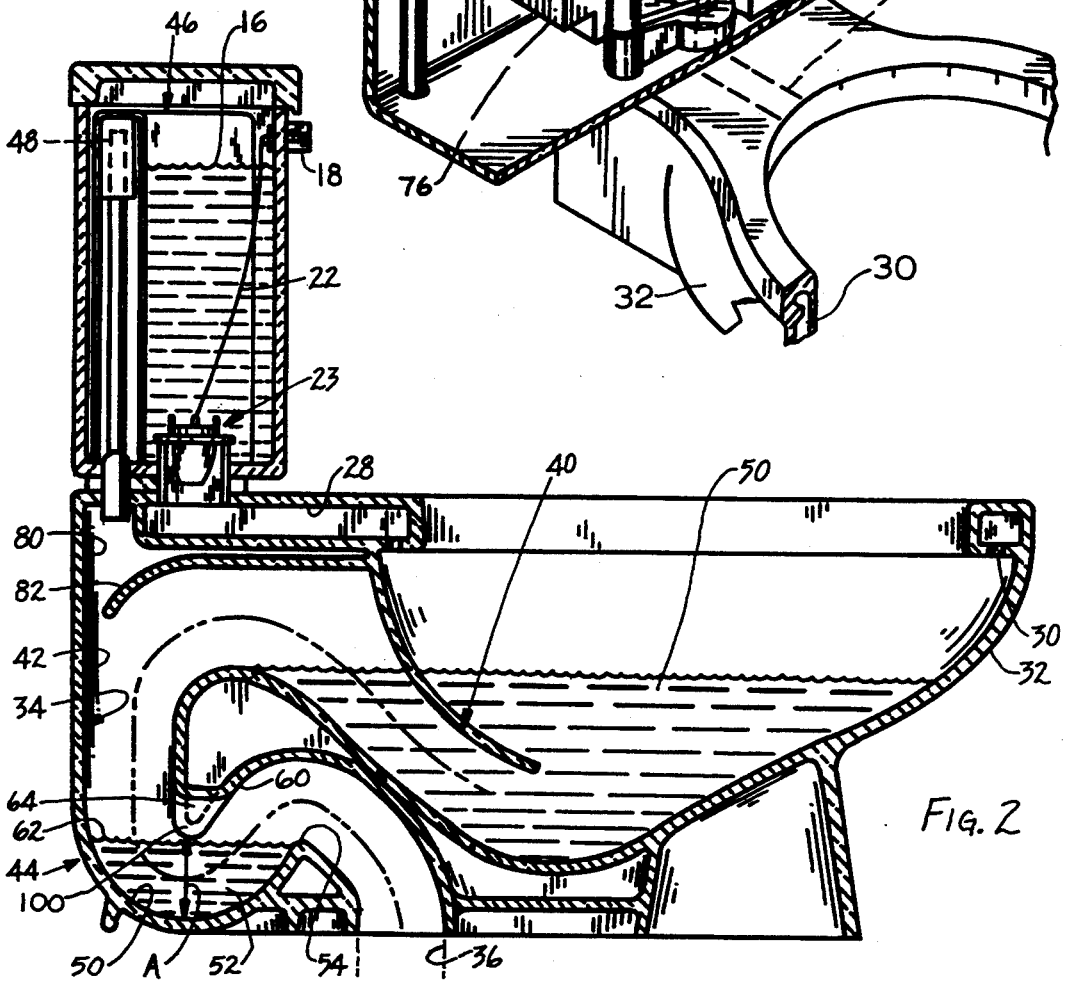
FIG. 2

FIG. 9
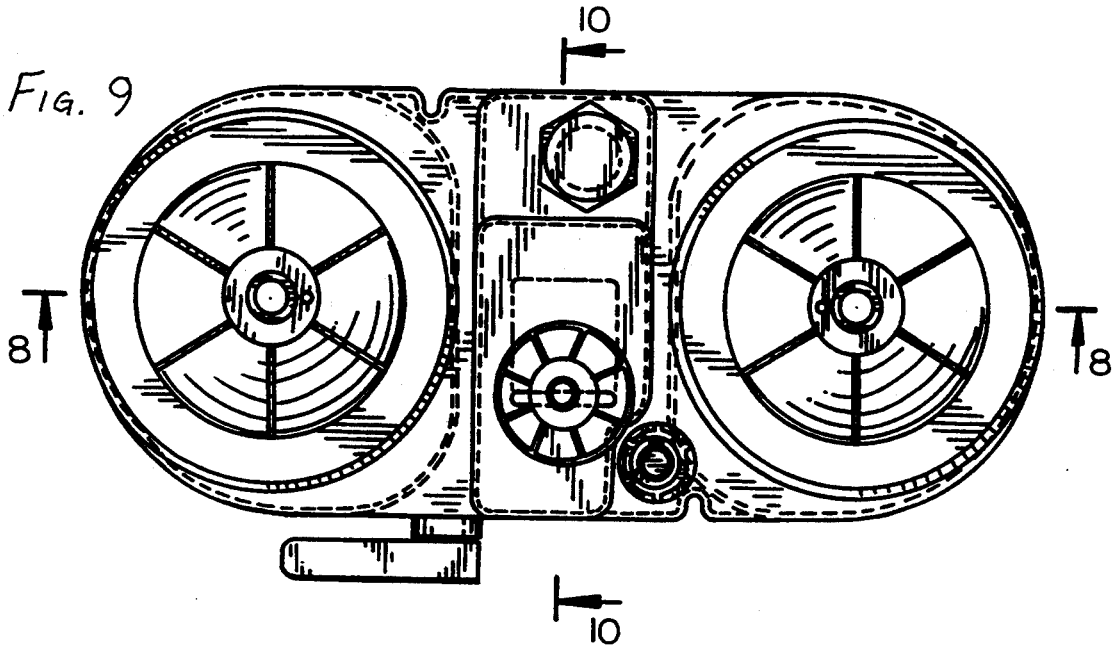
FIG. 10
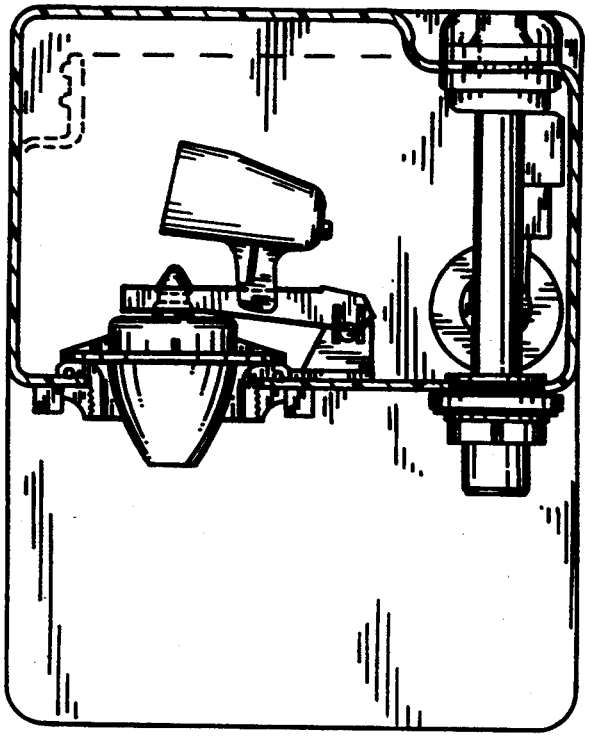
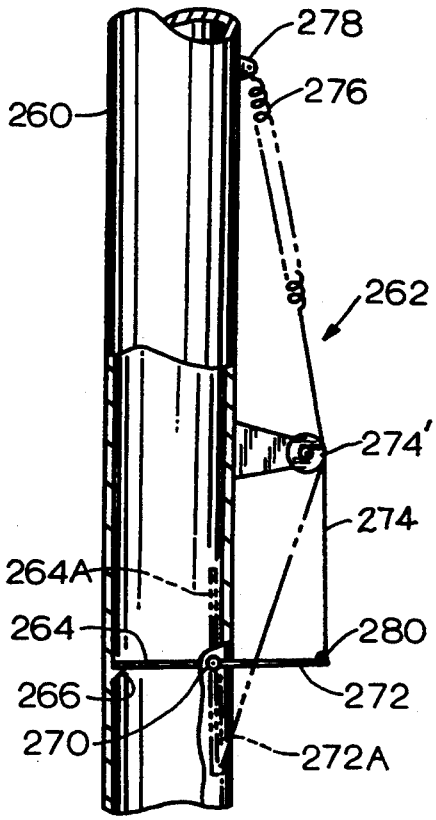
FIG. 11

VACUUM ASSISTED TOILET WITH CONTROLLED VACUUM

BACKGROUND OF THE INVENTION

Applicant's U.S. Pat. No. 5,142,712 describes a vacuum assisted toilet, wherein a vacuum is applied to the toilet bowl outlet during a flushing, so less water is required for a complete flushing. The toilet bowl outlet includes a lower trap, in addition to the usual upper trap, with a trapway extending between them and receiving the vacuum during a flushing. The lower trap is open to the passage of air between flushings, to prevent all water in the toilet bowl from being siphoned out. However, soon after the beginning of a flushing, the lower trap is closed against the passage of air, so the vacuum applied to the trapway can help pull out the contents of the toilet bowl instead of having the vacuum dissipated to the drain or sewer system.

Although the vacuum assisted toilet described in applicant's U.S. Pat. No. 5,142,712 operates fairly well, applicant has experimented with the toilet in an attempt to obtain even better flushings. A better flushing is one which produces a more complete evacuation of the contents of the toilet bowl, using the same or less flush water. In such tests, items that both sink and float in water, such as marbles and plastic balls (of varying densities), are placed in the toilet bowl and the percent of the those items which are removed is measured. A toilet which was constructed to produce better flushings using a small amount of flush water, would be of value.

SUMMARY OF THE INVENTION

In accordance with one embodiment of the present invention, a vacuum assisted toilet is provided wherein a vacuum source applies a vacuum to a trapway that lies between upper and lower traps, during a flushing, which produces a better flushing. The vacuum source is constructed so during the early stages of a flushing, the vacuum source produces a vacuum of progressively greater volume, but does not substantially couple the vacuum to the trapway until a time after the flushing begins. The vacuum is preferably coupled to the trapway immediately (preferably within 0.5 second) after the lower trap is sealed against the loss of air. As a result, any vacuum applied before the lower trap is sealed is not wasted or detrimental, and when a vacuum is applied after the trap is sealed, a preferred vacuum level of about ten centimeters of water (four inches) is very rapidly achieved in the trapway to apply a large vacuum early during a flushing to help pull out the contents of the toilet bowl.

In one toilet which is of a "gravity" type, water fills a container to an initial first level prior to a flushing, with the water level dropping when a flushing begins so that air in direct contact with the top of the water is expanded to create a vacuum. A vacuum conduit extends from the trapway up above the initial water level, and down to below the initial level, where the open end of the conduit lies. When the water drops from the initial water level, the vacuum above the water cannot reach the vacuum conduit, and the volume and intensity of the vacuum increases. When the water drops to a third level at which the vacuum conduit end lies, a large amount of air rapidly flows through the vacuum conduit to rapidly raise the vacuum level in the trapway.

In a pressured water toilet, a movable divider separates a container into a water-containing portion and a vacuum portion, with a spring or the like pressurizing the water. The divider has a plug that plugs a proximal end of the vacuum conduit during a predetermined length of initial travel of the divider. As a result, the vacuum created in the vacuum portion of the chamber cannot reach the vacuum conduit until the vacuum portion has expanded a predetermined amount, when the vacuum is suddenly applied to the vacuum conduit.

In another toilet, a valve lies along the vacuum conduit. The valve substantially closes the vacuum conduit until a predetermined pressure differential is sensed across the valve or a predetermined time delay has occurred, at which time the valve opens.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial isometric view of a vacuum assisted toilet of one embodiment of the present invention.

FIG. 2 is a sectional side view of the toilet of FIG. 1.

FIG. 9 is a plan view of the water and vacuum source of FIG. 8.

FIG. 10 is a view taken on the line 10—10 of FIG. 9.

FIG. 11 is a partial sectional view of a portion of a vacuum conduit constructed in accordance with another embodiment of the invention.

DESCRIPTION OF THE PREFERRED EMBODIMENTS

Figure 3:
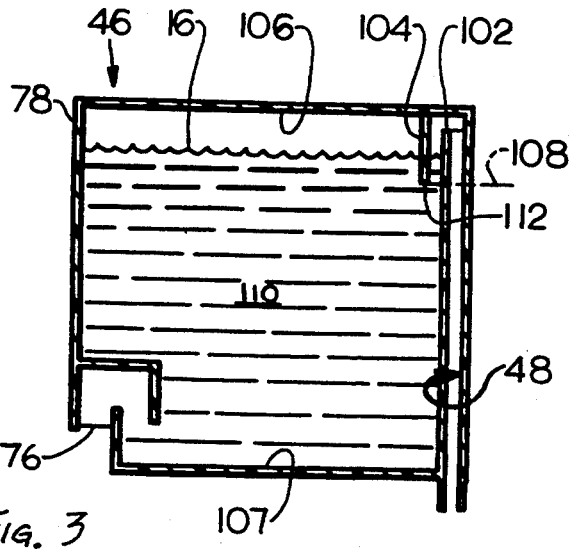
FIG. 3 is a partial sectional view of the water and vacuum source of the toilet of FIG. 1.

FIG. 1 illustrates a vacuum assisted toilet 10 which includes a water closet or tank 12 that holds a conventional water inlet valve 14. The inlet valve dispenses water into the tank until the water reaches a predetermined high water level 16, and also dispenses water through a refill tube 17 to fill the toilet bowl. When a handle 18 of a flush valve assembly 25 is manually operated, by pivoting it, a rod 20 and chain 22 are lifted to operate a flush valve 23 by pivoting a flush valve member 24 to lift it off a primarily upwardly facing flush valve seat 26. Water in the tank flows rapidly through the seat 26 and through a water tunnel 28 and through toilet bowl orifices 30 into a toilet bowl 32 (the seat is not shown). As shown in FIG. 2, the toilet bowl 32 has a toilet bowl outlet 34 that carries water and waste to a drain 36 that connects to a sewer system.

The toilet bowl outlet 34 includes an upper trap 40 coupled to the toilet bowl 32, a trapway 42 extending generally downwardly from the upper trap, and a lower trap 44 extending from the trapway to the drain. A water and vacuum source 46 is coupled through a vacuum conduit 48 to the trapway 42, to apply a vacuum therein during flushing of the toilet. The vacuum in the trapway draws water and waste from a pool of water 50 lying in the toilet bowl, to supplement the flushing forces resulting from the sudden flowing of water onto the top of the bowl pool. The application of the vacuum minimizes the amount of water which must be used in a flushing, to obtain an effective flushing wherein almost all of the contents in the pool is removed, including debris that floats and debris that sinks.

Most conventional toilets have a single trap at 40 which prevents sewer gas rising in the drain 36, from passing through the toilet bowl into the bathroom. The trap 40 forms a gas-tight seal. The lower trap 44 does not form a gas-tight seal, except during a flushing. The lower trap has a lower wall 50 that forms a container which holds a pool of water 52, at a height A (above the bottom of the pool) that is determined by the height of the downstream end 54 of the container. The lower trap has an upper wall 60 that lies above the top 62 of the pool, to leave an air-containing gap or air passage 64. The air passage 64 assures that the lower trap cannot serve as a siphon to draw out all water from the toilet bowl at the end of a flushing. A short time after the beginning of a flushing, the air passage 64 is sealed by the rapid flow of water therethrough, so that the vacuum applied to the trapway 42 will not be dissipated to the drain. It may be noted that most of the toilet bowl outlet 34 is of a constant cross section such as circular or rectangular (with rounded corners). However, there is a narrow vent 100 forming a narrow but tall passageway portion, which has a small cross sectional area so it rapidly fills with water near the beginning a flushing, but is tall enough to avoid the possibility of siphoning out water from the toilet bowl after a flushing.

The vacuum and water source 46 includes a container 78 (FIG. 1) that lies within the tank 12. The container is sealed from the rest of the inside of the tank, except at a lower container opening 76 that opens to the rest of the tank. At the beginning of a flushing, when flush valve member 24 is lifted and water begins to flow to the toilet bowl, the level of water in the tank which is originally at 16, rapidly falls, creating a vacuum at the top of the container 78. This vacuum will be applied through the vacuum conduit 48 to a cavity 80 (FIG. 2) that connects to the trapway 42. It is possible to form the tank 12 as a sealed unit, to avoid the need for a separate container therein.

A flush cycle lasts for a period such as three seconds, during which water in the tank rapidly flows into the toilet bowl to raise the level of the pool 50 therein, and the water in the toilet bowl exits through the toilet bowl outlet 34. For a following period of perhaps a half-minute, the toilet bowl is refilled. For the present toilet, about six liters of water is used in each flushing when solid waste is present, which is about one-half that required for a toilet bowl of the same design, but without vacuum assist or a lower trap. The vacuum source 46 applies a vacuum of about ten centimeters (four inches) of water during a flushing to achieve these results. Effective use of the vacuum requires that the lower trap 44 be closed to the passage of air, early during a flushing, preferably before one-quarter of the water in the toilet bowl has left the upper trap.

FIG. 3 shows some details of the water and vacuum source 46, which includes the container 78 and the vacuum conduit 48. The container has an upper portion 106 that contains air and a lower portion 107 that contains water, with the volumes of these portions changing. The vacuum conduit 48, which may be considered part of a container device that includes container 78, has a top 102 lying a distance above the first or maximum water level 16. A barrier 104 isolates the top of the vacuum conduit from the air-containing upper container part 106, until the level of water in the container drops to a third level 108 which is at the bottom of the barrier. At the beginning of a flushing, as the quantity of water 110 drops, the volume of the air space 106 expands, and the intensity of the vacuum (which is commonly measured in inches or centimeters of water) increases. Just before the level of the quantity of water 110 reaches the bottom 112 of the barrier, the lower trap will have become sealed against the passage of air therethrough. When the top of the quantity 110 of water reaches the bottom 112 of the barrier and begins to fall below it, the vacuum in the upper part 106 of the container is suddenly connected to the vacuum conduit 48 (i.e. air is suddenly drawn from the trapway to the upper part of the container). Since the vacuum in the container upper part 106 is of a large volume and considerable intensity (e.g. 40 cm of water), it causes the vacuum intensity in the trapway to rapidly rise. As a result, a considerable vacuum is rapidly established in the trapway, to rapidly begin pulling out the contents of the toilet bowl, soon after the lower trap is closed.

In a previous vacuum assisted toilet described in applicant's U.S. Pat. No. 5,142,712, there was no barrier 104. As a result, when the top of the quantity of water 110 fell from the initial position 116 and created a vacuum in the container upper part or portion 106, this vacuum was immediately applied to the trapway, where it was dissipated to the drain, until the lower trap was sealed. The water level had dropped to a level just above the level 108 when the trap closed. Accordingly, at the time when the lower trap closed, there was substantially no vacuum in the upper part 106 of the container, although a vacuum started to be created. The intensity of the vacuum in the trapway increased relatively slowly, because of the increased volume in the container upper portion 106 above the level 108, as well as from the fact that a vacuum started to be created only at the time that the lower trap was closed. In the present invention, where a vacuum of substantial intensity and volume is already created at the time that the lower trap is closed, with this vacuum suddenly applied to the trapway soon after the lower trap is closed, applicant rapidly applies an intense vacuum to the trapway.

The delay in applying a vacuum to the trapway, also has the advantage of avoiding lowering of the pool of water 52 (FIG. 2) in the lower trap. If a vacuum is applied to the trapway before the lower trap is sealed, then this early vacuum creates a rapid upstream flow of air from the drain and through the lower trap and up through the trapway. This upstream air flow can cause the overflow of some of the water in the lower trap pool and result in a longer delay before the lower trap later closes. By not applying a substantial vacuum or air flow (at a rate of more than one liter per second) before the lower trap closes, applicant avoids degradation of the lower trap.

Figure 4:
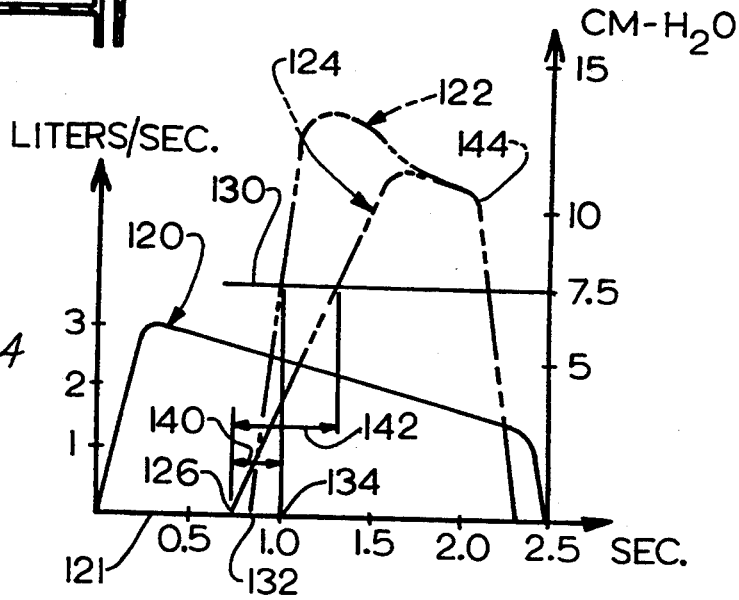
FIG. 4 is a graph showing variation in water flow out of the water- and-vacuum source with time, and variation of vacuum level in the trapway with time for a previous toilet and for the present toilet.

FIG. 4 includes a first graph 120 that represents the rate of flow of water out through the flush valve to the toilet bowl, as a function of time (flow out of the toilet bowl occurs perhaps 0.3 seconds later). During a flushing, about six liters of water flows out of the source into the bowl. At the time 121, about ten percent of the water has flowed out. At the time 126, the lower trap closes. FIG. 4 also includes a second graph 122 which shows the variation of vacuum intensity with time at the trapway of the toilet of the present invention. FIG. 4 also includes a third graph 124 which shows the variation in vacuum intensity with time for a trapway of a toilet of the type described in applicant's U.S. Pat. No. 5,142,712; in that toilet the upper portion of the container was continually connected to the trapway. It can be seen that for the third graph 124, the vacuum in the trapway begins at a time 126 that occurs immediately when the lower trap closes. However, it requires a considerable amount of time, such as perhaps one-half to three-quarters second for the vacuum intensity at the trapway to reach a substantial level 130 such as 7.5 cm of water, at which the vacuum can considerably aid in a flushing.

Graph 122, which represents the vacuum level in the trapway of applicant's present toilet, has a rapid rise from a time 132 to a time 134 when it reaches a vacuum intensity of 7.5 cm of water. The starting time 132 of the vacuum rise in the trapway occurs after ten percent of flush water has flowed from the source to the toilet bowl during a flush. The starting time 132 is delayed slightly from the time 126, to assure that the vacuum is applied only after the lower trap is closed, as an intense vacuum could draw water backward through the lower trap and delay its closing. The delay period 140 between trap closing and a trapway vacuum of 7.5 cm $H_2O$ is about one-third of the delay period 142 of the prior toilet before the vacuum reaches 7.5 cm of water. The vacuum level rapidly drops at a time 144 which is only about one and one-half seconds after the lower trap is closed, so that applying an intense vacuum about one-half second earlier than previously significantly increases the period during which an intense vacuum is applied to the trapway. The result is a significant increase in the quality of a flushing, that is, an increase in the percent of buoyant and nonbuoyant objects that will be flushed out.

It should be noted that the graphs of FIG. 4 are only rough approximations of what occurs, as the rates of flow and vacuum levels are very difficult to measure because of the rapid changes that occur over short periods of time. However, FIG. 4 gives an indication of the general effects. It also may be noted that the time 132 when the vacuum of the present invention is first applied, can be moved back to about the time 126, because the lower trap will close earlier if no vacuum and corresponding upstream air flow is applied before water flows rapidly downstream through the lower trap. The level of vacuum applied to the trapway should not exceed about 15 to 17 cm (6 to 7 inches) of water, or else some flush water and debris will be sucked up into the vacuum conduit. The relative volumes of the trapway and vacuum source (and to some extent the cross section of the vacuum conduit) are chosen to produce the proper vacuum level in the trapway.

Figure 5:
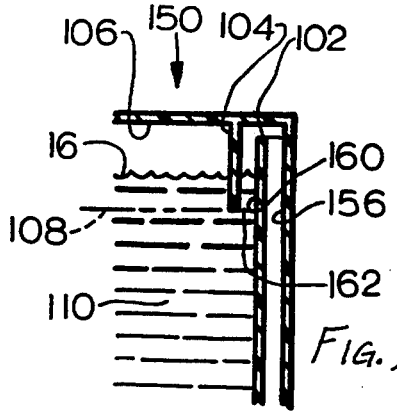
FIG. 5 is a portion of a water and vacuum source modified from that of FIG. 3.

FIG. 5 illustrates a portion of the container device 78 wherein applicant considers the vacuum conduit to include a top at 102 which lies above the maximum, or initial, water level 16. The vacuum conduit includes a first conduit portion 156 that extends downwardly from the top 102 to the trapway, and a second conduit portion 160 that extends downwardly from the top 102 to an open end 162 at level 108. The vacuum conduit end 162 initially lies in the quantity of water 110. This way of considering the container device, considers a barrier to be part of a vacuum conduit. Instead of coupling the lower end 162 of the vacuum conduit to the upper part 106 of the container, it would be possible to locate a check valve at 104. Such check valve would open when a predetermined pressure difference is sensed. Such pressure difference will occur when the volume of the vacuum reaches a predetermined amount. Such check valve is likely to be more expensive and less reliable than the system of FIGS. 1–5.

Figure 6:
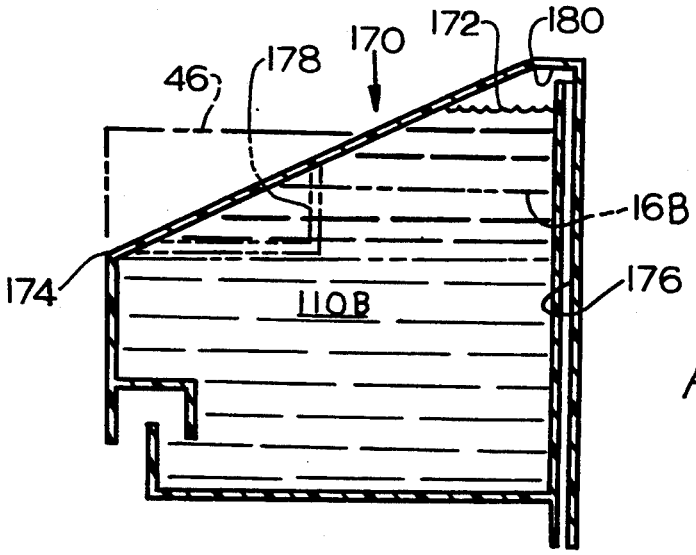
FIG. 6 is a partial sectional view of a water and vacuum source constructed in accordance with another embodiment of the invention.
Figure 7:
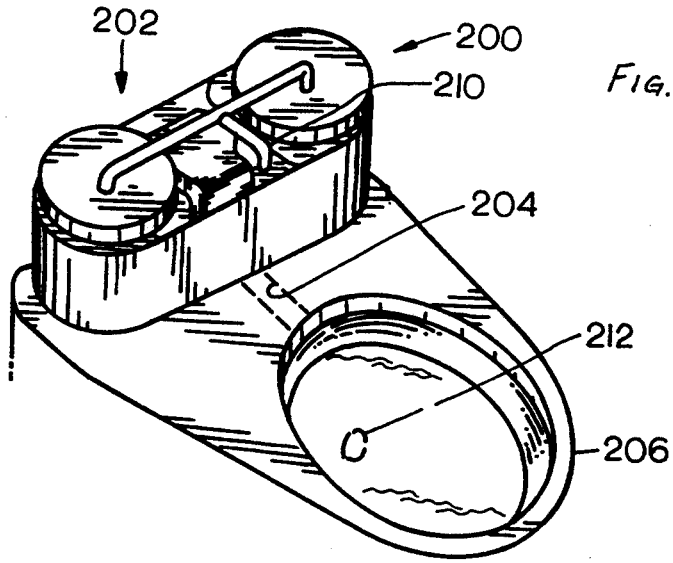
FIG. 7 is a partial isometric view of a pressured water, vacuum assisted toilet of another embodiment of the invention.

FIG. 6 illustrates a container device 170 which holds a quantity of water 110B at a level 172 which is above the level 16B corresponding to the level 16 in FIG. 3. This container device is tapered in cross sectional area, to have an increasing cross sectional area (as viewed from above) at progressively lower locations, down to a level 174. The vacuum conduit 176 is continually connected to the upper portion 180 of the container. The advantage of this arrangement is that the volume of vacuum that is dissipated to the drain before the lower trap is closed (i.e. the rate of flow of air from the trapway), is less than in applicant's previous patent, and once the lower trap is closed the vacuum volume increases at a greater absolute rate than previously (i.e. the rate of air flow increases). However, the amount of vacuum created while the water level drops from 172 to 16B is essentially wasted, even though this wasted amount is less than in the toilet of applicant's previous patent. Another advantage of this system over that in applicant's previous patent, is that it creates a smaller upstream air flow through the lower trap before the lower trap closes, to allow earlier closing. The container device could have the configuration shown at 178.

Figure 8:
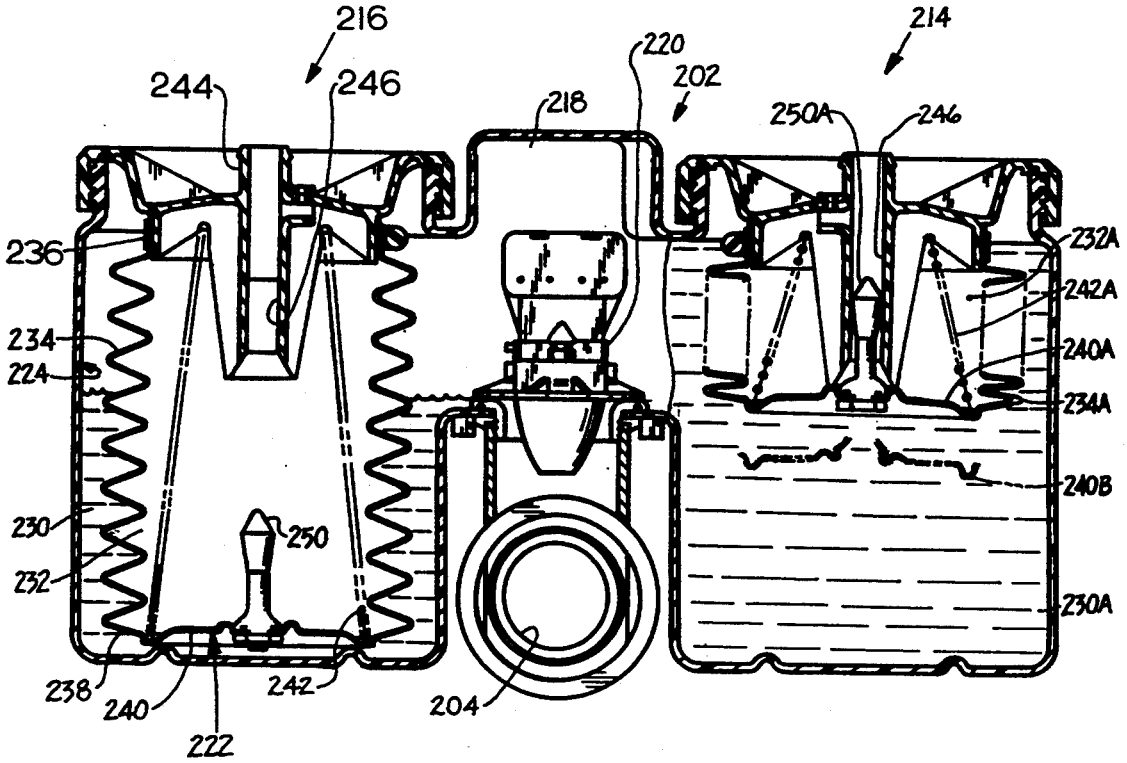
FIG. 8 is a sectional view of the water and vacuum source of the toilet of FIG. 7, with the right side of the figure showing the source full of pressured water, and the left side showing the source at it most empty position, FIG. 8 being a view taken on the line 8—8 of FIG. 9.

FIGS. 7–10 illustrate a vacuum assisted toilet 200 (FIG. 7) of a low profile type which stores water under the pressure of a spring or weight. The toilet includes a water and vacuum source 202 which flows water through a water tunnel 204 to a toilet bowl 206, and which applies a vacuum through a vacuum conduit 210 to the toilet bowl outlet 212. The toilet bowl outlet is of the construction shown in FIG. 2. As shown in FIG. 8, the source includes two substantially identical parts 214, 216 that are connected to a common valve box 218 where a flush valve 220 is located. Each part such as 216 includes a separator 222 lying in a container 224, and separating the container into first and second container portions 230, 232. The separator 222 is movable, with the particular separator shown including a bellows 234 with a fixed end 236 and with an opposite movable end 238 that supports a plate 240. The first container part 230 is a water chamber, while the second part 232 is a vacuum chamber. A spring 242 urges the separator towards the position shown for the part 216, wherein the water chamber 230 is of minimum volume and the vacuum chamber 232 is of maximum volume, which occurs near the end of a flushing. The vacuum chamber 232 is connected through a vacuum conduit 244 to the trapway of the toilet bowl outlet, the vacuum conduit including a proximal end portion 246 which is closest to the vacuum source.

In accordance with the present invention, applicant mounts a plug 250 on the separator plate 240, which can close the proximal end portion 246 of the vacuum conduit during the early stages of a flushing. The right half part 214 of the water and vacuum source, shows the source in its configuration before a flushing. At that time, the water chamber at 230A is of maximum volume and the vacuum chamber 232A is of minimum volume, with the spring at 242A and bellows at 234A being fully compressed by water pressure. The plug at 250A lies in the proximal end portion 246 of the vacuum conduit to plug it. At the beginning of a flushing, when the flush valve 220 opens and the plug 250A moves downwardly, the vacuum created in the vacuum chamber 232A is accumulated in the vacuum chamber. The vacuum accumulates until the separator plate moves from 240A to a release position at 240B, when the plug has moved out of the vacuum conduit and the vacuum is suddenly applied to the vacuum conduit. This construction has the same effect as the embodiment of FIGS. 1–3, in avoiding the application of a vacuum when it will be dissipated to the drain and will degrade the lower trap, while rapidly applying a vacuum to the trapway after the lower trap has been closed. Instead of having a part on the separator to plug the vacuum conduit, it would be possible for a part on the separator to operate a valve. The separator would keep such valve closed until the separator moves a predetermined distance away from its initial position (that it occupies between flushings), which occurs a predetermined time after a flushing begins.

FIG. 11 illustrates a vacuum conduit 260 with a valve 262 which keeps the vacuum conduit closed during the early stages of a flushing, when a vacuum source produces only a low negative pressure (i.e. below atmospheric). The valve 262 includes a pivoting valve member 264 which pivots off a seat 266 to an open position 264A when a predetermined pressure difference is sensed, such as four centimeters of water. The valve includes a shaft 270 that extends outside the vacuum conduit, where a lever arm 272 is connected to a flexible wire 274. The wire extends around a pulley 274 to a tension spring 276 that extends to a location 278 on the vacuum conduit. The spring 276 keeps the lever in its upward position shown in solid lines in the figure, until the predetermined pressure difference is sensed, when the spring force is overcome and the lever 272 starts to pivot downwardly towards the position 272A. As the lever starts to pivot down, the horizontal distance between the lever end 280 and the pivot axis at shaft 270 progressively decreases, so the valve tends to open to its full open position, and to remain thereat. However, when there is substantially no vacuum differential, which occurs near the end of a flushing, then the spring 276 causes the valve to close again. This valve can be used with a vacuum source that otherwise always connects the vacuum source to the trapway. It is possible to construct a valve along the vacuum conduit, which opens at a predetermined time after the beginning of a flushing (when the flush valve is first opened), such as to open at 0.7 second after the beginning of a flushing, to produce the same effect. A predetermined pressure differential and a predetermined time, will occur when the volume of the vacuum chamber is a predetermined amount.

The vacuum conduit should be "substantially" closed between the beginning of a flushing and closing of the lower trap, so that the vacuum intensity in the vacuum source is at least half the intensity that would be achieved if the vacuum conduit were completely closed during this period. It should be noted that the lower trap does not have to include a pool of water with a gap above it; for example, the lower trap can include a pool without a gap above it, plus a bypass air valve that closes during a flushing. In that case, the vacuum conduit connection is delayed for a shorter period such as one-quarter second. After water begins to flow out of the toilet bowl into the trapway, it is desirable that the rate of water flow into the bowl approximately equals the rate of flow from the bowl to the trapway; this encourages emptying of the pool of water in the toilet bowl as a somewhat cohesive body so debris is not left behind. A toilet of the present invention can be a urinal type, where the bowl is smaller than for a sit-down toilet that must flush solid waste.

Thus, the invention provides a vacuum assisted toilet which applies a vacuum to the toilet bowl outlet during a flushing, which can rapidly increase the vacuum level in the toilet bowl outlet for more effective vacuum assist. The vacuum source, which may be part of a water and vacuum source, is constructed so it has a vacuum of considerable intensity (preferably above five centimeters of water and more preferably at least ten centimeters of water) and considerable volume (preferably at least one liter) which is applied to the toilet bowl outlet immediately after the lower trap is closed. This can be accomplished by progressively expanding the volume of a vacuum chamber, but delaying coupling of the vacuum chamber to the toilet bowl outlet until a particular vacuum level is reached, or the chamber has expanded to a particular volume, or at a particular time after the beginning of a flushing, all of which are the equivalent of one another. In a gravity operated toilet, where the level of water in a container drops from a maximum level during a flushing, the vacuum conduit can extend above the maximum water level and down to a level that is below the maximum water level, so the vacuum is not applied to the vacuum conduit end until the water has dropped a predetermined amount. In a toilet with a pressured water source that creates a vacuum, a separator which separates a vacuum chamber from a water chamber, can include a plug that plugs a proximal end of the vacuum conduit a short time after the beginning of a flushing. The delay in vacuum application can be achieved by a valve along the vacuum conduit, which is initially closed, but which opens at a predetermined pressure difference or at a predetermined time.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A vacuum assisted toilet that includes a toilet bowl, a toilet bowl outlet, and a water and vacuum source which includes a container having a water-holding first container portion in connection with said toilet bowl and an air-holding second container portion that lie adjacent to each other and that have differential volumes so when the volume of said first container portion decreases the volume of said second container portion increases, a first apparatus adapted to be operated at the beginning of a flushing to release water in said first container portion so at least a portion of it flows out of said first container portion towards said toilet bowl, and a second apparatus which couples said second container portion to said toilet bowl outlet to apply a vacuum thereto during a flushing, characterized by:

said second apparatus which couples said second container portion to said toilet bowl outlet is constructed ,to delay coupling said second container portion to said toilet bowl outlet such that said second container portion is not in communication with said bowl outlet until the volume of said second container portion has reached a predetermined value after the beginning of a flushing.

2. The toilet described in claim 1 wherein:

said container is constructed to hold a quantity of water with a water top lying at a first level between flushings, said container having an upper portion forming said second container portion for containing air in direct contact with said top of said quantity of water, and said second apparatus includes a vacuum conduit coupled to said trapway, said vacuum conduit having a first part lying at a predetermined second level within said container that lies above said first level;

said container includes a barrier that surrounds said vacuum conduit first part to isolate it from portions of said container which lie above a predetermined third level which is below said first level, while coupling said vacuum conduit first part to container locations below said third level.

3. The toilet described in claim 1 wherein:

said container has a sealed upper portion and including a water inlet valve that allows water to fill said container to a predetermined height;

said second apparatus comprises a vacuum conduit with a top lying above said predetermined height, said vacuum conduit including a first conduit portion extending generally down from said top and coupled to said bowl outlet, and said vacuum conduit including a second conduit portion in communication with said first conduit portion extending down from said top to a location in said container which is below said predetermined height.

4. The toilet described in claim 1 wherein:

said container device comprises a movable separator between said first and second container portions and a vacuum conduit coupling said second container portion to said trapway, said vacuum conduit having a proximal end portion located within said second container portion, and said separator moves progressively away from said proximal end portion when said first container portion decreases in volume as water is released therefrom;

said separator having a plug that engages said vacuum conduit proximal end and keeps it closed to the passage of air therethrough until said second container has reached said predetermined value.

5. The toilet described in claim 1 wherein:

said second apparatus comprises a vacuum conduit with opposite conduit end portions which couple said second container portion to said toilet bowl outlet, said vacuum conduit being constructed to remain closed and opens only when a predetermined pressure difference exists between said opposite conduit end portions.

6. A vacuum assisted toilet that includes a toilet bowl, a bowl outlet, a container in communication with said toilet bowl that holds water between flushings of said toilet and that has an air-sealed upper portion, a water inlet valve that is coupled to said container to fill it with water to a predetermined height between flushings, a flush valve that is opened at the beginning of a flushing and that allows water to flow from said container toward said toilet bowl, and a vacuum conduit that couples said container upper portion to said bowl outlet, wherein:

said vacuum conduit includes a top lying above said predetermined height, a first conduit portion extending generally down from said top to said bowl outlet, and a second conduit portion coupled to said first conduit portion and extending down from said top to a location in said container which is below said predetermined height.

7. A vacuum assisted toilet that includes a toilet bowl, a toilet bowl outlet, a first apparatus for flowing water to said toilet bowl for a period of time during a flushing, and a second apparatus for applying a vacuum to said bowl outlet to withdrawal air within said bowl outlet to said second apparatus during a flushing, characterized by:

said second apparatus for applying a vacuum is constructed to not draw air out of to said bowl outlet until at least ten percent of the water that flows from said first apparatus to said toilet bowl during a flushing has flowed into said toilet bowl.

8. A method for operating a vacuum assisted toilet which includes a toilet bowl and a toilet bowl outlet that includes upper and lower traps and a trapway between said traps, which includes flowing water into a toilet bowl during a flushing from a water and vacuum source that holds a quantity of flush water, and creating a vacuum from said water and vacuum source and applying it to said trapway during a flushing, characterized by:

creating a vacuum of progressively increasing volume in said source during a flushing wherein said vacuum is not in communication with said trapway and connecting said vacuum to said trapway only after at least ten percent of the flush water has flowed out of said source toward said toilet bowl during a flushing.

9. The method described in claim 8 wherein:

said steps of creating a vacuum and flowing water into said toilet bowl, includes flowing water out of a lower portion of a substantially sealed container to progressively lower the level of water in said container and thereby create a vacuum in an upper container portion that lies above the level of the water in the container, and connecting said upper container portion to said trapway only after at least ten percent of the flush water has flowed out of said source toward said toilet bowl during a flushing.

10. The method described in claim 8 wherein:

said steps of creating a vacuum and flowing water include moving a divider that separates water and vacuum chamber portions of a container that are coupled respectively to said toilet bowl and through a vacuum conduit to said trapway, to contact said water chamber portion and expand said vacuum chamber portion, including closing said vacuum conduit with a device that is coupled to said divider so said device opens said vacuum conduit when said divider has moved to a predetermined position only after at least ten percent of the flush water has flowed out of said source toward said toilet bowl during a flushing.

11. The method described in claim 8 wherein:

said step of connecting said vacuum to said trapway includes establishing a vacuum conduit between said source and said trapway, with a valve device along said vacuum conduit which can block said vacuum conduit, and keeping said valve device closed to block said vacuum conduit during an early portion of a flushing and then opening said valve to connect said vacuum source to said trapway only after at least ten percent of the flush water has flowed out of said source toward said toilet bowl during a flushing.

12. A method for operating a vacuum assisted toilet which includes a toilet bowl and a toilet bowl outlet that includes upper and lower traps and a trapway between said traps, including flowing water from a water and vacuum source that holds a quantity of water and flowing the water into said toilet bowl during a flushing, and creating a vacuum in said water and vacuum source and applying said vacuum to said trapway to withdrawal air within said trapway to said water and vacuum source during a flushing, wherein said lower trap is open to the passage of air therethrough between flushings but is closed to the passage of air soon after the beginning of a flushing, characterized by:

establishing a vacuum in said source during a flushing, but connecting said vacuum to said to withdrawal air therefrom trapway only after said lower trap has been closed.

13. A method for operating a vacuum assisted toilet which includes a toilet bowl and a bowl outlet that includes upper and lower traps and a trapway between said traps, wherein said lower trap holds a pool of water with a pool top at a predetermined height between flushings and said lower trap has an upper wall lying above said pool top to form an air passage, including flowing water into said toilet bowl at the beginning of a flushing and flowing water and debris out of said toilet bowl through said bowl outlet so water flows into said lower trap which raises the level of said pool to block said air passage, and drawing air out of said trapway to a vacuum source, wherein:

said step of drawing air put of said trapway to said vacuum source occurs only when said air passage is blocked.

14. A vacuum assisted toilet that includes a toilet bowl, a toilet bowl outlet, a first apparatus for flowing flush water to said toilet bowl for a period of time during a flushing, and a second apparatus for applying a vacuum to said bowl outlet during a flushing, characterized by:

said second apparatus for applying a vacuum is constructed such that said second apparatus is not in communication with said bowl outlet until at least ten percent of the flush water that flows from said first apparatus to said toilet bowl during a flushing has flowed into said toilet bowl;

said bowl outlet includes a pool of water with an air-containing gap lying above said pool between flushings, with said lower trap being closed early during a flushing by flush water, and said second apparatus is constructed to apply a vacuum from a container, with the volume of said vacuum being at least one liter and having an intensity of at least ten centimeters of water at the time of connection of said second apparatus to said bowl outlet, within about one second after said lower trap is closed.

* * * * *